US007156164B2

(12) United States Patent
Helms et al.

(10) Patent No.: US 7,156,164 B2
(45) Date of Patent: Jan. 2, 2007

(54) HEAT EXCHANGER

(75) Inventors: Werner Helms, Esslingen (DE); Markus Reck, Stuttgart (DE); Stefan Weise, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 0 days.

(21) Appl. No.: 10/520,703

(22) PCT Filed: Oct. 31, 2003

(86) PCT No.: PCT/EP03/12138

§ 371 (c)(1),
(2), (4) Date: Jan. 10, 2005

(87) PCT Pub. No.: WO2004/051175

PCT Pub. Date: Jun. 17, 2004

(65) Prior Publication Data

US 2005/0252648 A1 Nov. 17, 2005

(30) Foreign Application Priority Data

Dec. 4, 2002 (DE) ..... 102 56 869

(51) Int. Cl.
*F28D 1/053* (2006.01)

(52) U.S. Cl. ..... 165/173; 165/176

(58) Field of Classification Search ..... 165/152, 165/153, 173–176
See application file for complete search history.

(56) References Cited

U.S. PATENT DOCUMENTS 4,938,284 A * 7/1990 Howells ..... 165/149
5,307,870 A * 5/1994 Kamiya et al. ..... 165/173

FOREIGN PATENT DOCUMENTS

| | | | |
|---|---|---|---|
| DE | 197 57 034 A1 | | 6/1999 |
| DE | 19757034 | * | 6/1999 |
| JP | 8-29089 | * | 2/1996 |
| JP | 8-29089 A | | 2/1996 |
| JP | 10-132487 | * | 5/1998 |
| JP | 10-132487 A | | 5/1998 |
| WO | WO 02/04881 | * | 1/2002 |
| WO | WO 02/04881 A1 | | 1/2002 |

* cited by examiner

*Primary Examiner*—Teresa J. Walberg
(74) *Attorney, Agent, or Firm*—Foley & Lardner LLP

(57) ABSTRACT

The invention relates to a heat exchanger (10) with tubes (80) and a collector box (20). Said collector box (20) has a tube-plate (30) with tube openings (60) and with angled or rounded lateral regions (110,120).

6 Claims, 4 Drawing Sheets

HEAT EXCHANGER

Figure 1A:
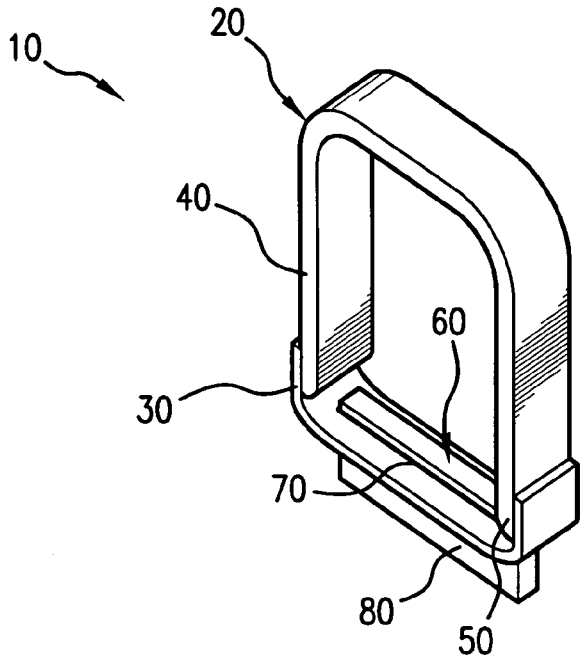

The present invention relates to a heat exchanger, in particular a charge-air cooler for a motor vehicle.

To increase the power of an internal combustion engine, it is possible for the air which is to be fed for combustion to be compressed, for example using a turbocharger, before it is fed to the combustion chambers of the internal combustion engine. However, compressing the air at the same time also heats it, and this is disadvantageous for an optimum sequence of the combustion process. By way of example, this can cause premature ignition or increased emissions of nitrogen oxides. To avoid the disadvantageous consequences of combustion of superheated air supplied, a heat exchanger designed as a charge-air cooler, which can be used to cool the compressed air to an acceptable temperature before its combustion, is connected downstream of a turbocharger.

A charge-air cooler is described, for example, in DE 197 57 034 A1. In the heat exchanger disclosed therein, the hot air is introduced into a first header passage of the heat exchanger, where it is distributed and flows into flat tubes which open out into the header passage. The flat tubes are arranged next to one another and with the side faces which include the long sides of their cross section parallel to one another, forming a flow path through which cooling air is routed. Cooling fins, which are responsible for effective heat exchange between the flat tubes and the cooling air stream, are arranged between the flat tubes in the flow path. After the cooling air stream has passed through, the flat tubes open out into a second header passage, which feeds the cooled, compressed charge air flowing into it for combustion in the engine.

In heat exchangers, such as in particular charge-air coolers of this type, the tubes are usually fitted into openings in a tube plate and soldered in place in a fluid-tight manner. Each time that compressed air is applied, this soldered join or joints is subject to high mechanical loads on account of rapid pressure changes. In particular the narrow sides of flat tubes do not satisfy the increasing demands on strength, which can result in leaks in particular in regions of tube-plate joins or joints of this type which face the sides of the tube plate.

A simple way of increasing the strength of tube-plate joins is to use tubes and/or tube plates with a greater wall thickness or external and/or internal fins with a greater material thickness. The increased mechanical stability is useful in both cases, but the increased outlay on materials costs and weight required is very high.

Other proposed solutions deal with a reduction in the mechanical loading on the tube-plate joins by the use of tie rods in the charge-air boxes. These tie rods stabilize the charge-air boxes and thereby relieve the load on the tube-plate joins, but also increase the outlay on material and the pressure loss caused by the charge-air cooler.

The object of the invention is to provide a heat exchanger, in particular a charge-air cooler, in which mechanical loads on tube-plate joins are reduced without an increased outlay on materials.

This object is achieved by a heat exchanger having the features of claim 1.

According to claim 1, a heat exchanger has tubes which are suitable to have a first medium flowing through them and a second medium flowing around them, so that heat can be transferred from the first medium to the second medium or vice versa. At least one header box which is in communication with the tubes comprises at least one tube plate, which has a substantially planar central region and at least one side region which is rounded or angled-off with respect to the central region. It is preferable for the tube plate to have two in particular opposite side regions which are rounded or angled-off with respect to the central region. In the central region there are tube openings, into which the tubes can be inserted in order to form the communicating connection to the header box.

Working on the basis of the discovery that the geometry of the header box under compressive load approximates to a spherical form as a result of deformation, since the shape of a sphere has the largest possible volume of all three-dimensional bodies for a given surface area, the basic idea of the invention is to approximate the geometric shape of a cross section through the tube plate to a sector of a circle, so that deformations which occur as a result of a compressive load on the header box are reduced, thereby reducing the mechanical loads on connections of tubes to the tube plate. For this purpose, at least one of the tube openings in the central region of the tube plate advantageously extends to the at least one side region or into the at least one side region. This ensures that at least one region of the tube-plate join, which faces the side region, adjoins a region of the tube plate which is rounded or angled off with respect to the central region. As a result, this region of the tube-plate join is located in a region of the header box which, in the case of compressive loads, has a reduced deformation and therefore reduced mechanical stresses. It is preferable for the tube opening to extend into the rounded or angled-off side region, but even if it only extends to the side region the mechanical loads on a tube-plate join are already reduced.

The configuration of the heat exchanger according to the invention increases its mechanical strength and therefore also its service life without requiring an increased outlay on materials, an increased number of parts or a longer production time.

In the context of the present invention, a central region of a tube plate is to be regarded as substantially planar if the tube plate is mostly planar in this region. In particular a tube plate central region with edges of tube openings which are deformed to produce what are described as rims and/or with other minor deviations from planarity is to be considered as substantially planar in the context of the invention.

Advantageous embodiments of the invention form the subject matter of the subclaims.

According to one embodiment, the at least one side region of the tube plate comprises one or more planar subregions, so that the header box has a faceted form. This allows reliable production with low manufacturing tolerances.

It is preferable for the at least one side region to have a rounded portion with an approximately constant radius of curvature or a plurality of rounded portions with different radii of curvature. This results in a particularly good approximation to a semicircular cross section of the tube plate.

A continuously convex form of the at least one side region also serves to improve the approximation to a semicircular shape of the tube plate cross section. Concave subregions which are subject to high levels of deformation in the event of compressive loads are thereby avoided.

According to an advantageous configuration, the tube plate has rims which delimit the tube openings and as appropriate face into the header box or out of the header box. These rims serve to increase the contact surface area between the inserted tubes and the tube plate, thereby strengthening the tube-plate join. It is particularly advantageous for the rim of the at least one tube opening at or in the at least one side region to be lower than in the central region of the tube plate. This reduces the surface area on which mechanical stresses emanating from the side region can act on the tube-plate join, whereas a high stability of the tube-plate join is retained in the central region of the tube plate.

According to a preferred refinement, the heat exchanger according to the invention is designed as a charge-air cooler which can particularly preferably be used in motor vehicles. In particular, the charge-air cooler has two header boxes, a first of which is intended to distribute charge air and a second of which is intended to collect charge air. It is advantageous for each of the header boxes to have precisely one tube plate, which is provided with a row of tube openings. It is also advantageous to use a row of flat tubes with in particular soldered corrugated fins between them, since this increases the heat-transfer surface area. The cooling medium used is preferably air, although other cooling media, such as water or coolant, are also conceivable.

Figure 1B:
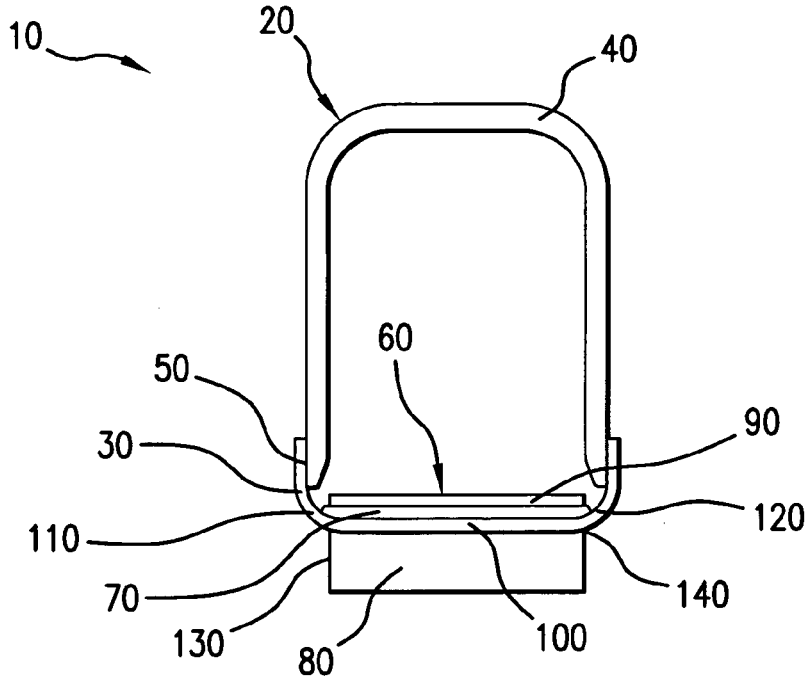
Figure 1C:
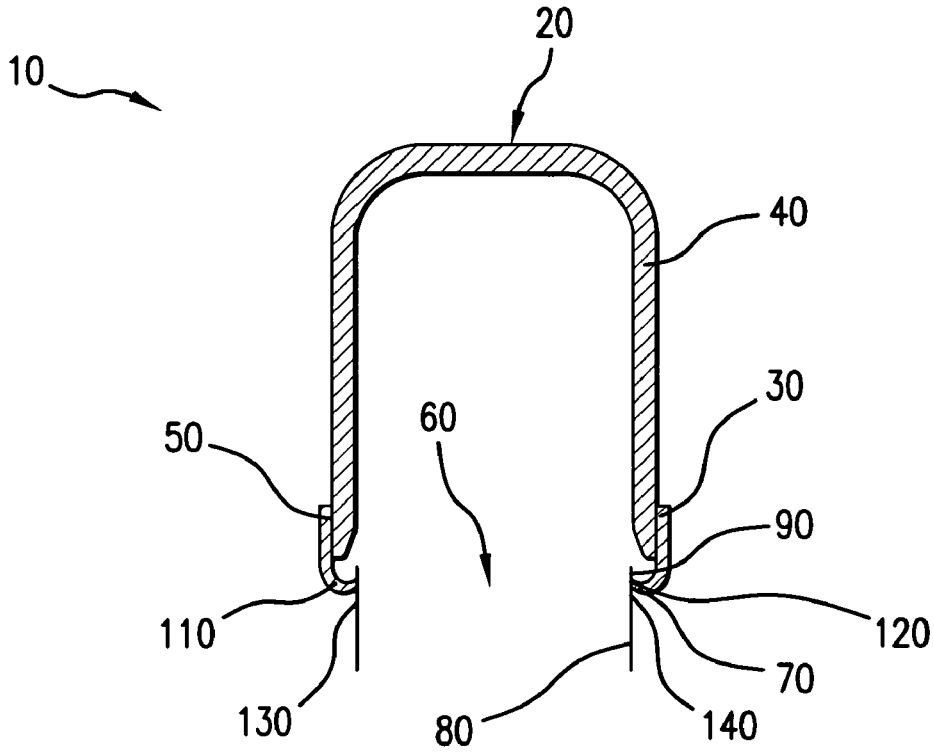
Figure 2A:
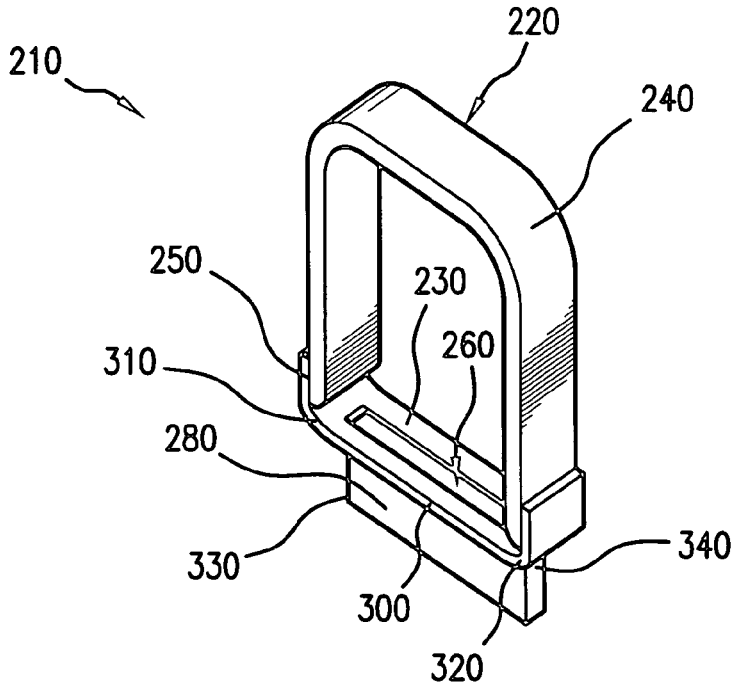
Figure 2B:
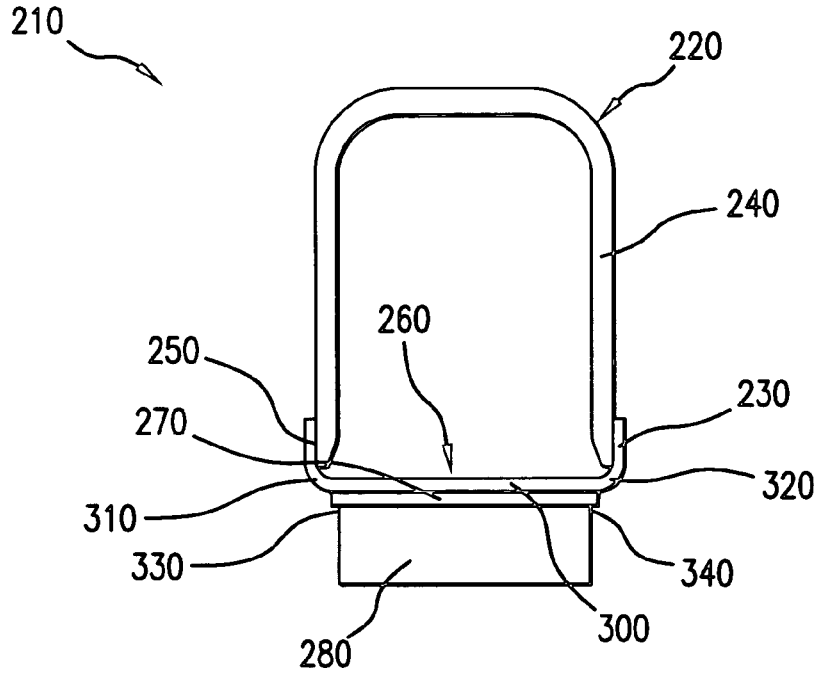
Figure 2C:
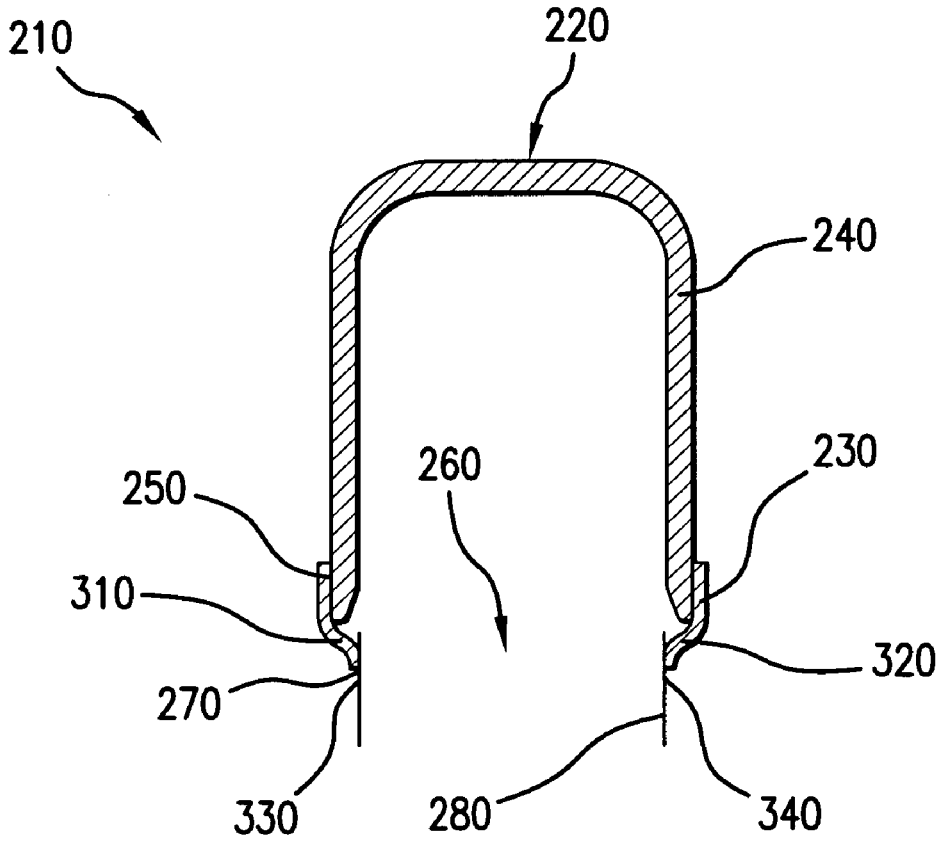

The invention is explained below on the basis of exemplary embodiments and with reference to the drawings, in which:

FIG. 1*a*: shows an excerpt from a heat exchanger according to the present invention, FIG. 1*b*: shows an excerpt from a heat exchanger, FIG. 1*c*: shows a cross section through a heat exchanger, FIG. 2*a*: shows an excerpt from a heat exchanger, FIG. 2*b*: shows an excerpt from a heat exchanger, and FIG. 2*c*: shows a cross section through a heat exchanger.

FIG. 1*a* shows an excerpt from a heat exchanger 10 in the form of a perspective illustration. A header box 20 for distributing a first medium comprises a tube plate 30 and a box cover 40, which are welded to one another at a common contact surface 50. In this case, the box cover 40 is fitted into the tube plate 30. However, it is also conceivable for the box cover 40 to be fitted onto the tube plate 30 or attached to the tube plate 30 in some other way. In other exemplary embodiments (not shown), a tube plate and a box cover are joined to one another by soldering, adhesive bonding or a positive lock or are formed as a single part or integrally with one another, i.e. for example from a deformed plate. The tube plate 30 has a tube opening 60, the edge 70 of which is deformed into the interior of the header box as what is described as a rim. A substantially rectangular flat tube 80 is fitted into the tube opening 60 and soldered or welded to the tube plate 30. Corrugated fins which adjoin the flat tube 80 on both sides and are soldered to the flat tube, so that heat transfer from the first medium to a second medium flowing around the tube 80 and the fins or from the second medium to the first medium is increased, are not shown. In total, the heat exchanger 10 comprises an entire row of alternating flat tubes and corrugated fins, which form what is known as a tube-fin block.

As can be seen from the side view shown in FIG. 1*b*, the tube 80 is fitted into the tube opening 60 sufficiently far for an upper edge region 90 of the tube 80 to project beyond the rim 70. This ensures good utilization of an inner surface, which cannot be seen but faces the tube 80, of the rim 70 as a bearing surface for a tube-plate join. This serves, for example, to ensure sealed soldering. To avoid an unnecessarily high pressure drop of the first medium across the heat exchanger, the extent to which the tube 80 projects above the tube plate 30 is to be minimized. For this reason, the tube opening 60 is located in a substantially planar central region 100 of the tube plate 30.

If the header box 20 is acted on by the first medium, the header box 20 is under certain circumstances deformed in such a manner that its cross-sectional shape approximates to a circular shape. To, as it were, anticipate such deformation, side regions 110, 120 of the tube plate 30 are angled off with respect to the central region 100. This results in reduced deformation of the tube plate 30 when the header box 20 is under compressive load in these side regions 110, 120. The end sides 130, 140 of the flat tube 80, which in mechanical terms are under the highest loads in the event of such pressure-induced deformations, are relieved of load by virtue of the fact that the tube opening 60 and therefore also the tube 80 extend into the side regions 110, 120 of the tube plate 30. The reduced deformation of the tube plate 30 which is present there reduces the mechanical load on the tube 80 and/or the tube-plate join.

FIG. 1*c* shows a cross section through the heat exchanger excerpt from FIG. 1*a* or FIG. 1*b*, the section plane running transversely through the tube 80. When this view is compared with FIG. 1*b*, it can be seen that on account of the fact that the tube opening 60 extends into the side regions 110, 120 of the tube plate 30, which are angled off with respect to the central region 100, the rim 70 has a reduced height at the end sides 130, 140 of the flat tube 80. This brings the additional advantage that there is a reduced surface area on the tube 80 for pressure-induced deformations to act upon. The reduction in the bearing surface area for the tube-plate join which is accepted at the same time can be tolerated, since a significantly larger part of the rim 70 retains a height which is sufficient to stabilize the tube-plate join in the planar central region 100 of the tube plate 30.

FIGS. 2*a*, 2*b* and 2*c*, analogously to FIGS. 1*a*, 1*b* and 1*c*, show a further exemplary embodiment of a heat exchanger 210 according to the invention, which differs from the previous exemplary embodiment mainly by virtue of the fact that the rim 270 is deformed such that it faces out of the header box 220. The tube plate 230 is welded to a box cover 240 at the common contact surface 250. A substantially rectangular flat tube 280 has been fitted into the tube opening 260 having the rim 270 and soldered or welded to the tube plate 230.

To reduce a pressure drop across the heat exchanger in a first medium flowing through the header box 220 and inter alia through the tube 280, the rim 270 faces out of the header box 220, so that the tube 280, which has been fitted in the rim 270, does not project above the tube plate 230 in its substantially planar central region 300. Side regions 310, 320 of the tube plate 230 are angled off with respect to the central region 300, in order to reduce deformation of the header box 220 under compressive load at least in the side regions 310, 320. To relieve the load on the end sides 330, 340 of the flat tube 280, the tube opening 260 and therefore the tube 280 extend as far as the side regions 310, 320, as can be seen particularly clearly from FIG. 2*c*.

Although in this exemplary embodiment the advantage of the reduced rim height is no longer present, the load on the tube 280 and/or the tube-plate join is nevertheless likewise reduced on account of the S-shaped cross section of the tube plate 230 in the cover connection 250—side region 310/320—rim 270 region.

The invention claimed is:

1. A charge-air cooler having tubes and at least one header box to which the tubes are connected, the header box being configured to receive hot compressed charge-air that is subject to rapid pressure changes and having at least one tube plate, the tube plate having (i) a substantially planar central region with tube openings formed therein and into which the tubes are fitted and secured with a sealed joint, and (ii) at least one side region which is rounded with a substantially constant radius of curvature with respect to the central region, wherein the at least one tube opening extends from within the generally planar central region at least up to the at least one side region and wherein the at least one tube opening is delimited by a rim which extends out of the tube plate in a direction away from the at least one header box, whereby said rounded side portion of the tube plate and said rim adjacent to said rounded side portion form in cross-section a generally S-shaped configuration sufficient to decrease load on said sealed joint as a result of said joint being subjected to rapid pressure changes exerted by the hot compressed charge-air.

2. The heat exchanger as claimed in claim 1, wherein the at least one side region has a plurality of rounded portions with different radii of curvature.

3. The charge-air cooler as claimed in claim 1, wherein the at least one side region is convex in form viewed from the side of the tube plate facing away from the header box.

4. A charge-air cooler having tubes and at least one header box to which the tubes are connected, the header box having at least one tube plate and being configured to receive hot compressed charge-air that is subject to rapid pressure changes, the tube plate having (i) a planar central region with tube openings formed therein and into which the tubes are fitted and secured with a sealed joint, and (ii) at least one side region which is rounded with a substantially constant radius of curvature with respect to the central region, and means for decreasing load on said sealed joint as a result of said joint being subjected to rapid pressure changes exerted by the hot compressed charge-air, said means comprising the at least one tube opening extending from within the generally planar central region at least up to the at least one side region and the at least one tube opening being delimited by a rim which extends out of the tube plate.

5. A charge-air cooler as claimed in claim 4, wherein the rim extends in a direction toward the at least one header box and wherein the at least one tube opening extends into the at least one side region by a distance large enough to cause the rim in the at least one side region to extend out of the tube plate by a distance that is less than the distance the rim extends in the planar central region of the tube plate, whereby there is formed a reduced area for pressure-induced deformation of the tube plate to act on said sealed joint.

6. A charge-air cooler as claimed in claim 4, wherein the rim extends in a direction away from the at least one header box and wherein said rounded side portion of the tube plate and said rim adjacent to said rounded side portion form in cross-section a generally S-shaped configuration sufficient to decrease load on said sealed joint as a result of said joint being subjected to rapid pressure changes exerted by the hot compressed charge-air.

* * * * *